United States Patent [19]

Neron et al.

[11] Patent Number: 4,510,825

[45] Date of Patent: Apr. 16, 1985

[54] MULTI-POSITION DRIVE RATCHET WRENCH

[76] Inventors: Joseph Neron, 4 Minnesota Ave., West Glen Falls; William S. Hudson, 5 Terra Cotta Ave., Glens Falls, both of N.Y. 12801; Ronald L. Miller, R.D. #1 Box #62, Geer Rd., Hudson Falls, N.Y. 12839

[21] Appl. No.: 485,759

[22] Filed: Apr. 22, 1983

Related U.S. Application Data

[63] Continuation of Ser. No. 202,428, Oct. 30, 1980, abandoned.

[51] Int. Cl.[3] ..... B24B 17/00

[52] U.S. Cl. ..... 81/57.29

[58] Field of Search ..... 81/57.29, 62, 63

[56] References Cited

U.S. PATENT DOCUMENTS

| | | | |
|---|---|---|---|
| 916,507 | 3/1909 | Van Wie | 81/57.29 |
| 2,701,490 | 2/1955 | Griparis | 81/57.29 |
| 3,733,936 | 5/1973 | Flynn | 81/57.29 |
| 3,952,617 | 4/1976 | Gegg | 81/62 |
| 3,972,252 | 8/1976 | Hunter | 81/57.29 |
| 4,086,829 | 5/1978 | Hudgins | 81/57.29 |
| 4,265,148 | 5/1981 | Gartzke | 81/57.29 |
| 4,318,314 | 3/1982 | Furedi et al. | 81/57.29 |

FOREIGN PATENT DOCUMENTS

| | | | |
|---|---|---|---|
| 1119464 | 4/1956 | France | 81/57.29 |

*Primary Examiner*—James L. Jones, Jr.

*Attorney, Agent, or Firm*—Cushman, Darby & Cushman

[57] ABSTRACT

A multi-mode wrench comprised of a drive head and a housing in which a drive system is positioned together with an axially and rotatably movable handle for selecting among various operating modes offered by that drive system. The wrench, accordingly, provides for a wide variety of bolt or nut tightening or loosening operations, making such work in especially tight or confined areas easier where it might not otherwise be possible to move wrenches in a normal oscillating fashion to apply torque to adequately tighten or loosen a connection. The wrench has five operating modes which vary from a fully, inner locked condition, where the housing, the drive system and the handle are all locked together so the wrench can operate like a box wrench, a neutral position where the drive system can idle within the housing and handle allowing for drive by various sorts of external mechanical or air driven drive means, two main drive positions where the handle can ratchet alternately in either clockwise or counterclockwise direction and an outer locked condition where the handle is locked directly to the drive system.

6 Claims, 7 Drawing Figures

MULTI-POSITION DRIVE RATCHET WRENCH

This is a continuation of application Ser. No. 202,428, filed Oct. 30, 1980 now abandoned.

BACKGROUND OF THE PRESENT INVENTION

1. Field of the Invention

The present invention relates to wrenches and specifically to a combination ratchet, gear drive and socket type wrench.

2. Description of the Prior Art

Over the years a wide variety of wrenches have been developed for a variety of particular purposes. These have included fixed jaw wrenches, suitable for working with a single size nut or bolt to the more modern types of vice grips and adjustable wrenches. Additionally, a variety of right angle ratchet and socket drive wrenches, some gear driven or combining ratchet and gear drives have been developed.

Exemplary of such prior art wrenches are those disclosed in the following U.S. Pat. Nos. 1,333,532, issued to Berk; 1,832,663, issued to Small; 2,703,030, issued to Marvin; 2,834,239, issued to Mancini; 3,707,893, issued to Hofman; 3,733,936, issued to Flynn; 3,972,252, issued to Hunter; 4,086,829, issued to Hudgins; 4,128,025, issued to Main et al; and 4,137,801, issued to Imperio.

The Hudgins wrench is a right angle ratchet wrench in which an internally located drive shaft is provided within a body. The shaft terminates at a bevel gear which is used to rotate a tang or lug. A clutch assembly at the end of the handle is used to translate rotational movement of the handle below a predetermined torque level to that bevel gear and when that torque level is reached so that further rotation of the handle will not be able to rotate the drive lug, the wrench can be used as an ordinary wrench, in an oscillating fashion, to further tighten the socket attached to lug 47. The drive shaft is permanently connected to the handle and axial movement of the handle moves the drive shaft and its bevel gear out of driving engagement with the tang.

Hofman also shows a right angle ratchet wrench comprised of a main tubular body member having an internal drive shaft terminating a bevel gear at one end and a bail fixed to the other. A sleeve type handle is rotatably mounted to the main tubular body and is provided with perpendicular cross-slots in its end in which the bail can be placed. The slots have different depths and by changing the bail from one to the other, the drive bevel gear is moved in and out of engagement with the tang. The handle can rotate so that when the bail is in one groove, the tang will be rotated and when in the second groove, the bevel gear will be disengaged and rotation of the handle has no driving affect.

Main et al and Imperio also show right angle ratchet wrenches which like Hofman and Hudgins are comprised of hollow body members with internal drive shafts rotatably mounted therein. Each has a handle or knob coupled to the internal drive shaft and rotation thereof causes rotation of the drive shaft and a lug drivingly connected to the opposite end of the drive shaft. Both patents show various means for selectively moving the drive shaft so that the bevel gear at its drive end is in or out of contact with the drive lug.

Flynn discloses a right angle ratchet wrench that also employs a drive knob, like Main et al, for rotating a drive shaft mounted within a tubular handle. Marvin discloses a ratchet wrench that includes a hand crank for high speed operation and the crank, as it is moved into and out of its operational position, also moves the drive shaft to engage and disengage a drive bevel gear with the tang.

Each of the above include ratcheting means of some type in the head or tang end of the wrenches, thus, making each a relatively complicated structure.

Hunter, Berk and Small show other types of wrenches and Mancini shows a type of roller friction ratcheting device. We are also aware of one way clutch assemblies disclosed on page 7 of the pictorial handbook of technical devices published in 1971 by the Chemical Publishing Co., Inc.

SUMMARY OF THE PREFERRED EXEMPLARY EMBODIMENT OF THE PRESENT INVENTION

The present invention relates to a right angle ratchet wrench having a variety of drive modes which can be used to drive a tang or lug member on which various size conventional sockets can be removably placed. The wrench is comprised of a main body member or housing and includes head and tubular body portions which can be formed as an integral unit or which can be formed separately and held together so that they can be released from one another. A drive shaft is located within this main housing and a rotatable drive tang is connected to the head portion and is drivingly connected to one end of the drive shaft through suitable gearing. The other end of the drive shaft extends outwardly beyond the tubular sleeve or barrel portion of the housing and a hollow handle member is positioned over both the tubular barrel portion and that portion of the drive shaft which extends beyond the tubular barrel portion.

The drive shaft is provided with a plurality of circumferentially extending grooves which coordinate with a ball detent device located interiorly of the hollow handle in order to correctly position the handle relative to the drive shaft which remains in a fixed position once in place within the housing. The end of the drive shaft opposite from the head portion is provided with its own socket which is accessible through the end of the tubular handle. Splines are provided on both sides of that socket as well as at the end of the barrel portion of the housing lying within the hollow handle and complementary splines are located interiorly within the hollow handle structure itself. The drive shaft is also provided with a circumferentially extending drive sleeve positioned so that at various times, one of a plurality of roller clutches, also located within the tubular handle, can engage that sleeve in order to provide a driving engagement in either a clockwise or counterclockwise direction depending upon the positioning of the handle and one of the roller clutches with respect to the drive sleeve.

The rotating hollow handle is also capable of being moved axially along the drive shaft and is used to select one of the various operating modes capable of being used. That selection depends upon where the hollow handle is positioned, axially, relative to the drive shaft.

There are five possible positions available and only one can be used at a time although it is very easy to change from one to another as desired depending upon the situation then faced. In a first position, the hollow handle lies in its closest position to the head portion of the housing and when in that position, the external spline located at the end of the barrel portion, the external spline at the outer end of the drive shaft socket will both engage with complementary splines located within the handle. Thus, the handle will lock both the housing and the drive shaft together into an integral unit. Thus, all the drive system elements and housing will be locked together. In this condition, the wrench can be used as a normal non-ratcheting socket wrench and can tighten and loosen bolts in the normal manner by oscillating the wrench through an arc about the axis of the bolt or nut or about the axis of the drive tang at the head end of the wrench.

By moving the handle rearwardly, one notch, to its second position the two sets of splines will be disengaged and neither of the roller clutches will be in contact with the drive sleeve. Accordingly, the drive shaft, the handle and the housing will all be in a neutral, free wheeling position. By attaching any sort of external drive device in the socket located at the handle end of the drive shaft, the drive lug at the head end can be rotated in any direction and the barrel and the handle can be used to hold or support the wrench while the internal drive shaft is moved therein independently of both and in either of two directions. In this condition, the wrench can be applied to a bolt or a nut and even if there is not sufficient room to move the wrench through an arc, as described above or there is insufficient room to effectively use the handle in either the third or fourth operational modes, as described hereafter, it will be possible to loosen or tighten the bolt or nut by means of an external drive system of some type applied to the socket on the drive shaft.

Moving the handle rearwardly from the head portion one more notch to the third position will effect engagement between one of the one way roller clutch assemblies and the drive sleeve and will allow the handle to ratchet in a clockwise fashion, while driving the tang in a counterclockwise direction. Moving the handle rearwardly one more notch to the fourth position disengages the first roller clutch and causes the other one way roller clutch assembly to engage that same drive sleeve and allows the handle to ratchet in the opposite direction while driving the tang in a clockwise direction.

Another set of splines is located on the interior end of the socket located on the drive shaft and a corresponding set of mating splines is located on the inside of the hollow handle rearwardly of the rearmost mounted roller clutch. Accordingly, when the handle is moved to its fifth position such that the ball detent unit lies on the drive shaft just in front of the drive sleeve or in another groove provided at that point, these two splines will mate locking the handle to the drive shaft without locking the handle to the housing. In that position, the handle will be in its fully extended position away from the head portion of the wrench and might provide sufficient length, in a very tight situation, to allow another wrench to grip the handle, if leverage could be better achieved in that manner, to turn the drive tang. By connecting the handle to the drive system and, accordingly, to the drive tang, more torque could be applied than might otherwise be the case if only the handle were being gripped by an individual's hand.

While attempts have been made to simplify combined, ratchet and gear drive wrenches, the attempts have, for the most part, failed. The present invention not only provides the long sought answer of simplicity, but also presents a highly useful combination wrench having a wide variety of drive capabilities, including use as a torsional drive wrench, a ratcheting and hand operated gear drive wrench, a socket wrench and one allowing use of external drives.

Other objects, features and characteristics of the present invention as well as the combination of parts and economies of manufacture, will become more apparent upon consideration of the following detailed description and the appended claims with reference to the accompanying drawings, all of which form a part of this specification, wherein like reference numerals designate corresponding parts in the various figures.

BRIEF DESCRIPTION OF THE DRAWINGS

Reference will now be made to the drawings included herewith wherein.

DETAILED DESCRIPTION OF THE PREFERRED EXEMPLARY EMBODIMENT OF THE PRESENT INVENTION

Figures 1, 2, 3:
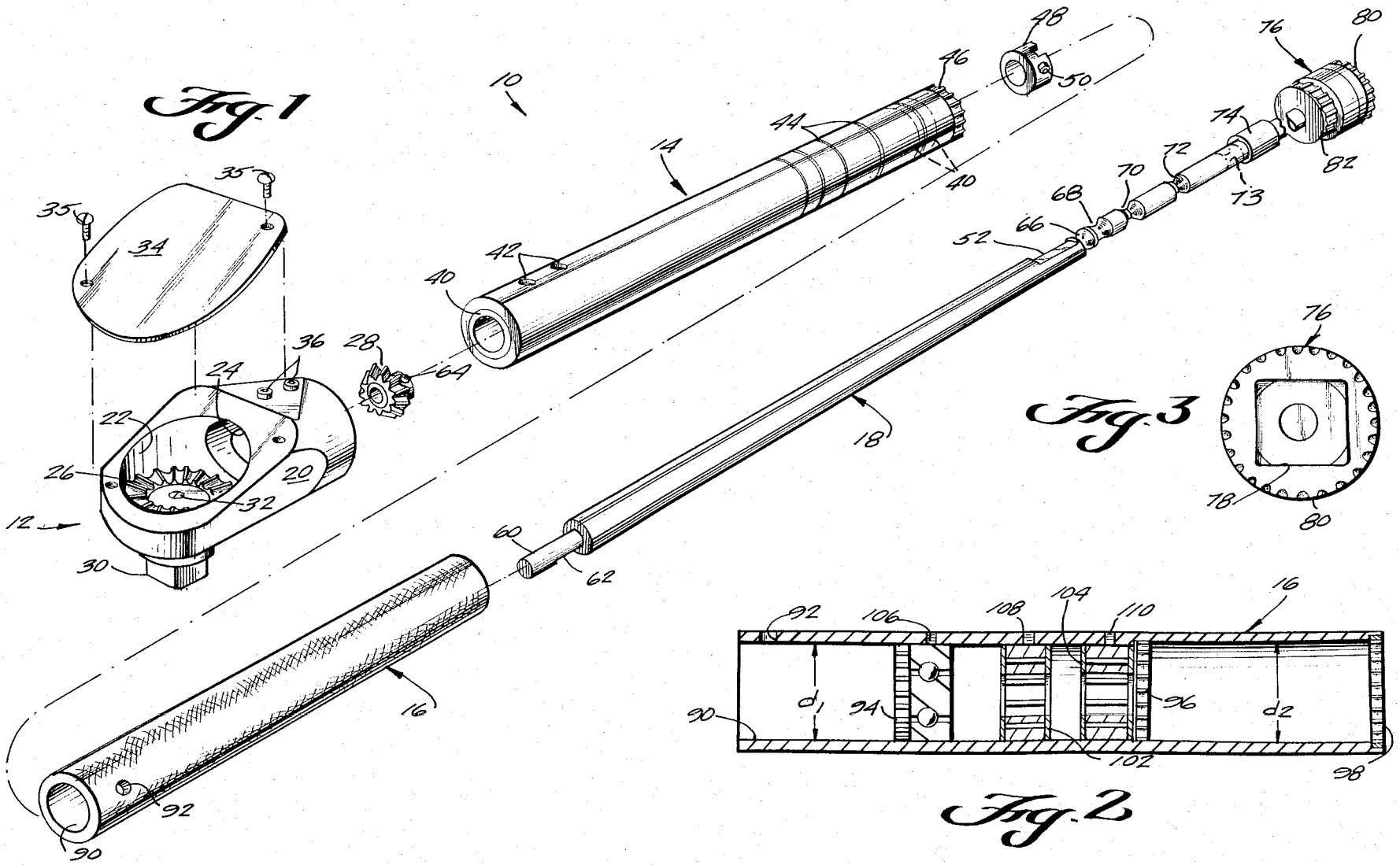
FIG. 1 is a diagrammatic, exploded, perspective view of the wrench made according to the present invention.
FIG. 2 is a diagrammatic, cross-sectional view of the hollow handle shown in FIG. 1.
FIG. 3 is a diagrammatic, end, elevational view of the socket end of the drive shaft.
Figure 4:
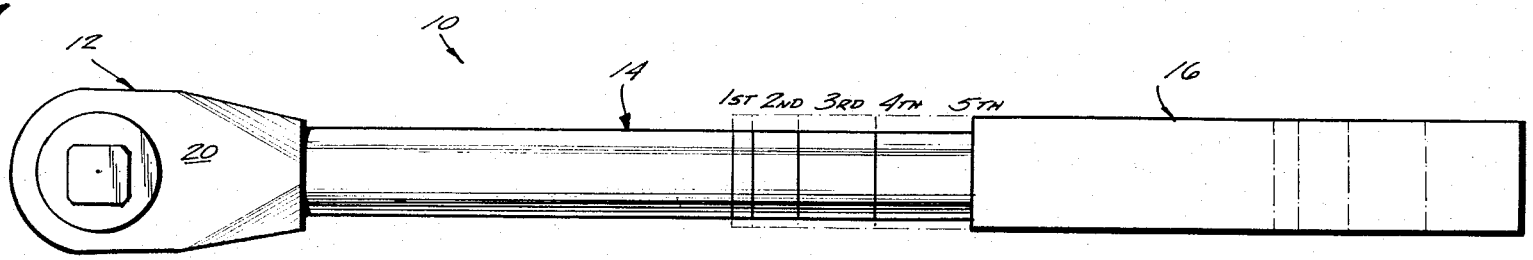
FIG. 4 is a bottom plan view of the wrench shown in FIG. 1, but in its assembled condition.

Turning our attention first to FIGS. 1 and 4, the wrench produced, according to the present invention, is generally indicated at 10 and is comprised of a head portion 12, a tubular barrel 14, a hollow drive handle assembly 16 and a drive shaft 18.

Head portion 12 includes a housing 20 which is provided with two interior chambers 22 and 24 that can be either machined or forged in head portion 12. Interior chamber 22 is designed to receive a bevel gear 26 therein as well as miter gear 28 with the latter driving bevel gear 26. Gears 26 and 28 are positioned substantially perpendicular to one another. Chamber 24 also receives the inner portion of barrel 14 and allows miter gear 28 to pass therethrough so that it can come into driving engagement with bevel gear 26. A drive lug or tang 30 is connected to bevel gear 26, for example, by screw 32. Alternatively, drive lug or tang 30 could be integral with and an extension of bevel gear 26 with that structure being held in place by means of thrust washer and a snap ring (not shown). It should be understood that there could be a number of ways to connect bevel gear 26 and drive tang 30 together so that they operate as an integral unit and any one of those approaches would be suitable.

Head portion 12 also includes a cover 34 held on by screws 35 and allen screws 36.

Barrel 14 is a tubular structure provided with bearings 40 at each end for respectively receiving and rotatably supporting the main portion of drive shaft 18. Barrel 14 is also provided with guide holes 42 for receiving allen screws 36 and when the forward end of barrel 14 is in position within interior chamber 24 of head portion 12, holes 42 will line up beneath allen screws 36 and when those screws are tight, they lie within holes 42 and securely hold barrel 14 into head portion 12.

Barrel 14 is also provided with a number of score lines 44 to indicate to the user what particular mode of operation in which the handle assembly 16 is positioned. Handle 16 is shown in FIG. 4, in full and phantom lines, within its five available axial positions. The first position is indicated by the phantom lines closest to head portion 12 and is marked 1st. As the handle is moved rearwardly away from head portion 12, the handle will move along drive shaft 18 as will be more fully explained hereafter thereby selecting from among the various operating positions that are available.

Barrel 14 is also provided at its rear end with a spline 46. It should also be noted that I prefer to have bearing 40 in that same end, as shown in phantom in FIG. 1, is recessed inwardly from that end a distance at least equal to the length of retaining collar 48 which is positioned on drive shaft 18 so that the allen screw 50 located therein will seat on flattened area 52 of drive shaft 18. Thus, miter gear 28 and retaining collar 48 together act to position shaft 18 within barrel 14 and prevent shaft 18 from moving axially as handle 16 is moved.

The front or forward end of drive shaft 18 is formed with a reduced shaft area 60 on which a flattened area 62 is provided for receiving allen screw 64 of miter gear 28 so that miter gear 28 can be properly positioned at the front end of drive shaft 18.

Drive shaft 18 is also provided with four circumferentially extending grooves 66–72 and a drive sleeve 74. Grooves 66–72 are located rearwardly of flattened area 52, but ahead of drive sleeve 74. Continuing toward the rear end of drive shaft 18 is a drive socket, generally indicated at 76, which is provided at its end, as shown in FIG. 3, with a drive opening 78. Socket 76 is also provided with splines 80 and 82 which are respectively located at each end of socket 76 with both extending circumferentially about the periphery of each end as shown in FIG. 1.

Tubular drive handle assembly 16 can have a knurled outer surface, as shown in FIG. 1, and, as shown in FIG. 2, is formed from a tube having a first diameter d1 at its forward end so that it can slip over barrel 14 and a second an preferably larger diameter d2 at the opposite end so as to fit over socket 76.

The tubular drive handle assembly 16, as shown in cross-section in FIG. 2, includes a hollow interior 90 and an opening 92 adjacent the front end so that collar 48 and specifically allen screw 50 can be tightened in place on drive shaft 18. Three splines, 94, 96 and 98, as well as a ball detent mechanism 100 and two roller clutches 102 and 104 are also retained within the hollow interior 90 of handle 16 and are spaced apart in predetermined distances to coordinate with grooves 66–72 and drive sleeve 76 on drive shaft 18. Allen screws 106–110 can be used for respectively holding ball detent assembly 100 and roller clutches 102 and 104 in place within handle 16. Roller clutches 102 and 104 are located approximately in the center of handle 16 and each can be a Torrington roller clutch model RE061008. As explained above, roller clutch 102 can provide for clockwise ratcheting while applying driving forces in a counterclockwise direction while roller clutch 104 can allow for counterclockwise ratcheting and the application of clockwise driving forces. Each clutch operates with drive sleeve 74 as will become more clear hereinafter.

Ball detent assembly 100 is spaced forwardly away from roller clutch 102 toward that portion which overlies barrel 14, and spline 94 is located in front of ball detent assembly 100.

Spline 96 is located rearwardly of roller clutch 104 and spline 98 is preferably located adjacent the rear end of handle 16. Spline 94 will be positioned so that when handle 16 is in its first position, spline 94 will mesh and be in locked engagement with spline 46 at the rear end of barrel 14. At the same time, spline 98 will mesh and be in engaging contact with spline 80 on drive shaft 18. In this first position for handle 16, splines 94 and 46 lock together adjacent the front of handle 16 and splines 98 and 80 lock together adjacent the rear thereof. Thus, in this first locked position, handle 16 locks drive shaft 18 and barrel 14 together thereby placing the drive lug or tang 30 in a locked condition.

To assure the proper positioning of handle 16 with respect to drive shaft 18 and barrel 14, the spring loaded ball detent assembly 100 will be positioned within circumferential groove 66 which defines the first position for handle 16.

Circumferential groove 68 defines a second position for handle 16. When handle 16 is moved rearwardly one notch, ball detent assembly 100 engages groove 68. Splines 94 and 98 are respectively disengaged from splines 46 and 80 leaving drive shaft 18 free to rotate in either of two directions. It should be pointed out, that the combined effects of collar 28 and miter gear 28, maintain the positioning of drive shaft 18 with respect to barrel 46 and the head portion 12 so that as handle 16 is moved, axially, back and forth along the portion of drive shaft 18 which extends outwardly from the rear end of barrel 14, neither drive shaft 18 nor miter gear 28 will move.

By moving handle 16 to its next rearward most or third position, which places the ball detent assembly 100 about circumferential groove 70, roller clutch 104 will be brought into engagement about drive sleeve 74. In that position, because roller clutch 104 allows for counterclockwise ratcheting and the application of clockwise drive forces, rotation of handle 16 will likewise cause the rotation of drive shaft 18 in a clockwise direction. This rotates miter gear 28 in a like fashion and accordingly bevel gear 26 which in turn causes the clockwise rotation of drive tang 30 so that bolts or nuts can be tightened.

By moving handle 16 to its fourth position so that ball detent assembly 100 lies about groove 72, roller clutch 102 will now be in driving engagement with drive sleeve 74 and roller clutch 104 will have been disengaged from and moved rearwardly of drive sleeve 74. Roller clutch 102 allows for the application of counterclockwise drive forces to drive shaft 18 and for clockwise ratcheting.

It should be understood that notwithstanding the above described arrangement for the application of clockwise and counterclockwise drive forces by the relative positioning of clutches 102 and 104 with respect to drive sleeve 74, the function of these clutches could be reversed so that roller clutch 102 produces clockwise drive forces while roller clutch 104 allows the application of counterclockwise drive forces, with each allowing for the necessary complementary ratcheting in the opposite direction.

Moving handle 16 to its rearmost or fifth position positions ball detent assembly 100 on drive shaft 18 or if desired, in a fifth groove indicated in phantom at 73, located at a point behind groove 72 but forward of drive sleeve 74. This will disengage roller clutch 102 from drive sleeve 74 and bring splines 82 and 96 into locked engagement. In this position, handle 16 and drive shaft 18 will be locked together and turn as an integral assembly with respect to barrel 14 in either clockwise or counterclockwise directions. Thus, a suitable wrench could be applied to handle 16 which now is at its rearmost extension and might allow for just the additional amount of length needed to apply forces to a very tightly positioned bolt or nut. Even if one's hand were not able to grip handle 16 adequately enough to provide sufficient leverage to turn drive shaft 18, the extra length provided by having handle 16 in its fifth position might provide sufficient length to allow torque to be applied to handle 16 from another wrench used to grip the handle. In addition, even with the handle in this position the socket opening 78 of socket 76 is still accessible through the end of the handle to allow an additional tool to be positioned therein to assist in performing the task at hand.

Figure 5:
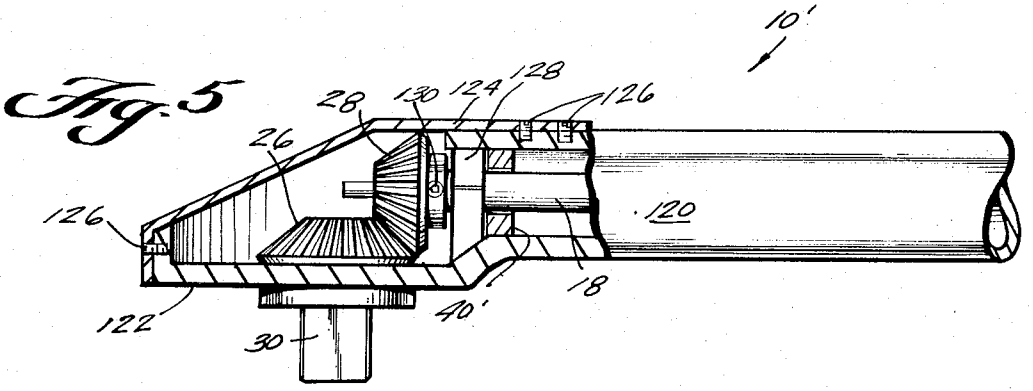
FIG. 5 is a diagrammatic, partial, side elevation view, in which portions have been cut away and are shown in cross-section for clarity, of a one piece structure for the head and barrel portions of the wrench.

Turning now to FIG. 5, head portion 12 and barrel 14 could be made as an integral one piece unit as is shown at 120 terminating in a forward portion 122 for defining together with a cover 124, secured to structure 120 by allen screws 126, a chamber for bevel gears 26 and 28. In this instance, we find it preferable to include a two-piece thrust plate 128 between miter gear 28 and bearing 40' in order to adequately secure the front end of drive shaft 18 within the chamber defined between cover 124 and the front portion 122 of the one-piece barrel and head structure 120. Further, thrust plate 128 also accurately positions miter gear 28 with respect to bevel gear 26. It should be understood, however, that while miter gear 28 is shown as being secured to drive shaft 18 in this embodiment by means of an allen screw 130, miter gear 28 could be secured to shaft 18 as well by means of a screw passing axially through the gear directly into an appropriately threaded hole in the end of drive shaft 18 or by any other convenient manner.

Figure 7:
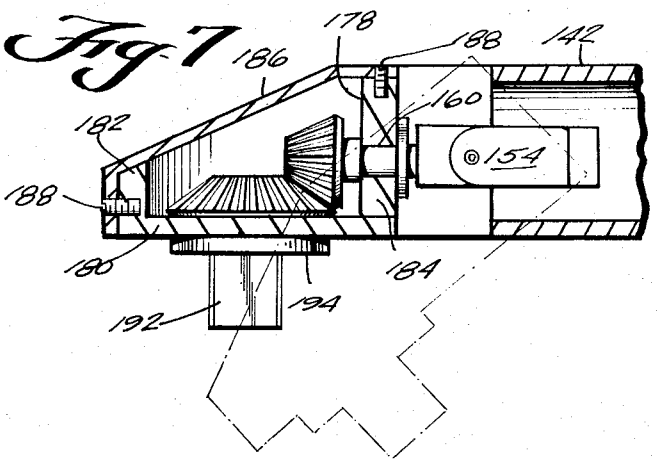
FIG. 7 is a diagrammatic, side, elevational view of a portion of the wrench shown in FIG. 6 from which portions have been cut away and shown in cross-section for clarity.
Figure 6:
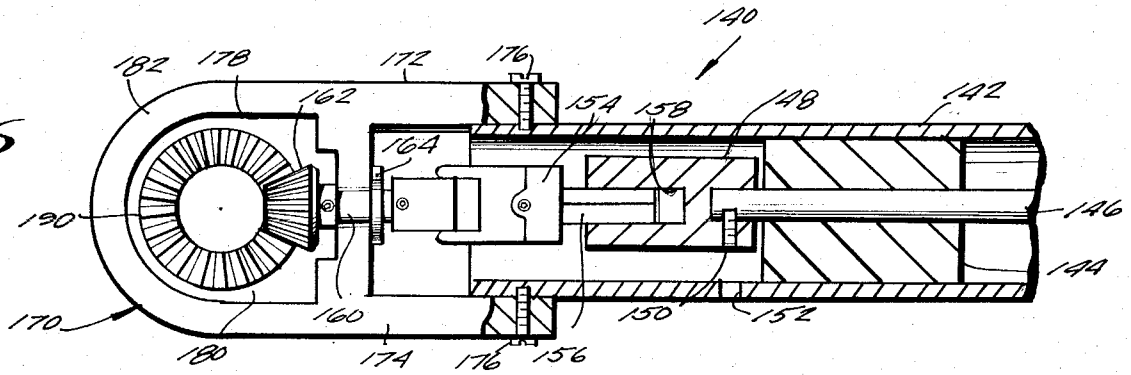
FIG. 6 is a top plan view of a portion of the head end of a wrench showing another embodiment of the present invention from which portions have again been cut away and shown in cross-section for clarity.

Turning now to FIGS. 6 and 7, an alternative embodiment for the present invention is set forth. The handle and barrel structure will remain essentially the same while the head portion is arranged so that it can swivel through an arc with respect to the axis of barrel 14 and at the same time continue to provide the same type of driving capabilities as with the first embodiment.

This embodiment is generally indicated at 140 and the barrel is indicated at 142. It is provided with an internal bearing 144 adjacent the front end thereof and serves to rotationally support the front end of drive shaft 146. In other respects, drive shaft 146 will be the same as drive shaft 18. In this instance, however, while drive shaft 146 terminates without having a reduced portion, it is secured within a rotating bearing 148 by means of allen screw 150 which can be inserted or removed through an opening 152 provided in the sidewall of barrel 142. A flexible angular coupling or universal joint 154 is provided with a sliding extension member 156 which is slidably retained within bore 158 provided in rotating bearing 148. The other end of the flexible angular coupling 154 is attached to a short connecting shaft 160 that connects the coupling to miter gear 162. To ensure proper spacing, washers shown at 164 can be employed and allen screws can be used to connect both the miter gear 162 and the coupling 154 to shaft 160.

A U-shaped head member, generally indicated at 170, is provided with two leg members 172 and 174, which are pivotally connected to barrel 142 by screws 176. The front portion of head member 170 is bored out or forged so as to define a chamber 178 therein in the forward portion thereof which is defined by a bottom wall portion 180, a front wall area that is generally U-shaped 182 and a rear wall 184. As shown in FIG. 7, 186 can be provided and held in place by any convenient means such as allen screws 188.

Also located within this chamber is bevel gear 190 which can be integrally connected to drive tang or lug 192 and again held in place by means of a thrust washer 194 and a snap ring (not shown). As shown in both FIGS. 6 and 7, drive shaft 160 extends through rear wall 184 and as indicated before, both miter gear 162 and coupling 154 are connected thereto. As head member 170 is moved away from the horizontal axis of barrel 142, either upwardly or downwardly, with the downwardly position being shown in phantom in FIG. 7, extensions 156 of coupling 154 will slide within rotating bearing 148 so that while rotation of head member 170 can occur, the drive system will not become disengaged.

It is preferred that the wrench according to the present invention be constructed from a high quality hardened steel although various other kinds of steel or other metals could also be used.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures.

What I claim is:

1. A right angle socket wrench having a plurality of operating modes comprising housing means for providing the main support for the wrench, drive system means movably positioned with respect to said housing means for providing a plurality of operational modes and for transmitting driving forces applied thereto, said drive system means including a drive lug, a drive shaft, gearing means for connecting said drive shaft to said drive lug and handle means adjustably mounted to said housing means and said drive shaft so as to be axially and rotatably movable with respect thereto for selecting one of said plurality of operational modes and for applying clockwise or counterclockwise driving forces to said drive shaft in only one of at least five predetermined operational modes, respectively, said plurality of operation modes includes clockwise and counterclockwise ratcheting together with complementary counterclockwise and clockwise drives, respectively, a fully locked condition in which said drive shaft, said housing means and said handle means are locked together as an integral unit, an idle condition mode for said drive shaft and said handle means where said drive shaft can be driven independently of said handle means and a partially locked condition where said handle means and said drive shaft are locked together independently of said housing means.

2. A combination, multi-mode wrench comprised of a housing, drive means movably mounted within said housing for providing a plurality of operating modes to transmit forces applied to said wrench, handle means mounted so as to be axially and rotatably movable with respect to both said housing and said drive means so that the axial positioning of said handle means selects among said plurality of operating modes and in predetermined ones of said plurality of operating modes provides the driving torque to said drive means, said plurality of operating modes including a first mode wherein said handle means in a first axial position so that said housing, drive means and handle means are all locked together, a second mode wherein said handle means is in a second, separate axial position and applied torque only to said drive means in a clockwise direction, a third mode wherein said handle means is in a third separate axial position and applies torque only to said drive means in a counterclockwise direction, a fourth mode wherein said handle means is in a fourth separate axial position in which said handle means is not operatively engaged with either said housing or said drive means with the latter free to rotate independently of both said housing and said handle means, and a fifth mode wherein said handle means is in a fifth separate axial position in which said handle means and said drive means are locked together independently of said housing.

3. A combination, multi-mode wrench as in claim 2, wherein said handle means can ratchet in counterclockwise and clockwise directions when said handle means is in said second and third modes, respectively.

4. A wrench as in claim 2, wherein said drive means can rotate both clockwise and counterclockwise in said fourth operational mode.

5. An adjustable wrench having a socket drive and a plurality of drive modes comprising a housing, drive means mounted to one end of said housing and being drivingly connected to said socket drive, drive transmission means rotatably mounted within said housing for transmitting driving forces applied thereto to said drive means, said drive transmission means extending outwardly from the other end of said housing, handle means positioned about at least that portion of said drive transmission means extending outwardly from said housing and being movable thereon for selecting among the plurality of drive modes and for engaging and driving said drive transmission means in predetermined ones of said plurality of drive modes, wherein said drive means includes a first and second bevel gears positioned at a substantially right angle to one another, said socket drive being secured to said first bevel gear, said drive transmission means including an elongated drive shaft having one end connected to said second bevel gear and a socket member secured at the other end, said drive shaft having a portion extending outwardly beyond said housing and having a plurality of spaced apart circumferential grooves positioned between said socket member and said housing and an enlarged drive sleeve positioned between said plurality of grooves and said socket member, wherein said handle means includes a hollow, tubular member having a front and rear end, first and second roller clutches mounted internally of said hollow, tubular member at first and second predetermined positions therein and roller ball detent means for positioning said handle means with respect to said drive transmission means, wherein said wrench further includes first locking means for locking said housing, said drive transmission means and said handle means together in one of said plurality of drive modes and second locking means for locking said handle means and said drive transmission means together in another one of said plurality of drive modes, wherein said first locking means includes two pairs of splines, one pair comprised of a spline positioned at the end of said housing from which said drive shaft extends and another spline positioned within said hollow, tubular member between said ball detent means and the front end thereof, the other pair comprised of one spline positioned about the outer periphery of said socket member and another spline positioned adjacent the rear end of said hollow, tubular member.

6. An adjustable wrench having a plurality of drive modes comprising a housing, socket drive means mounted at one end of said housing, drive transmission means rotatably mounted relative to said housing for transmitting driving forces applied thereto to said socket drive means, said drive transmission means extending outwardly from the other end of said housing, handle means positioned about at least that portion of said drive transmission means extending outwardly from said housing and being axially movable thereon for selecting among the plurality of drive modes and for engaging and driving said drive transmission means in predetermined ones of said plurality of drive modes, wherein said socket drive means includes first and second bevel gears positioned at a substantially right angle to one another and a socket drive lug being secured to said first bevel gear, said drive transmission means including an elongated drive shaft having one end connected to said second bevel gear and a socket member secured at the other end, said drive shaft having a portion extending outwardly beyond said housing and having a plurality of spaced apart circumferential grooves positioned between said socket member and said housing and an enlarged drive sleeve defined between said plurality of grooves and said socket member, said handle means including a hollow, tubular member having a front and rear end, first and second roller clutches mounted internally of said hollow, tubular member at first and second predetermined positions therein and roller ball detent means for positioning said handle means with respect to said drive transmission means, wherein said wrench further includes first locking means for locking said housing, said drive transmission means and said handle means together in one of said plurality of drive modes and second locking means for locking said handle means and said drive transmission means together in another one of said plurality of drive modes, wherein said second locking means is comprised of a pair of splines one positioned about the inner periphery of said socket member and another spline positioned within said hollow tubular member between said rear end thereof and said roller clutches.

* * * * *